US005987666A

United States Patent [19]

Zigmont

[11] Patent Number: 5,987,666

[45] Date of Patent: Nov. 23, 1999

[54] GAP-FILLING PAD DISPOSABLE BETWEEN A MATTRESS AND A BED RAIL

[75] Inventor: N. Darlene Zigmont, Akron, Ohio

[73] Assignee: St. Luke Foundation, N. Canton, Ohio

[21] Appl. No.: 09/268,404

[22] Filed: Mar. 15, 1999

[51] Int. Cl.[6] ..... A47C 21/08

[52] U.S. Cl. ..... 5/424; 5/663; 5/739

[58] Field of Search ..... 5/185, 424, 425, 5/427, 428, 430, 732, 739, 661, 663, 946

[56] References Cited

U.S. PATENT DOCUMENTS

| | | | |
|---|---|---|---|
| 4,409,695 | 10/1983 | Johnston et al. | 5/428 X |
| 4,669,136 | 6/1987 | Waters et al. | 5/185 X |
| 4,672,698 | 6/1987 | Sands | 5/424 |
| 5,035,014 | 7/1991 | Blanchard | 5/739 X |
| 5,044,025 | 9/1991 | Hunsinger et al. | 5/425 X |

OTHER PUBLICATIONS

Kara Parker and Steven H. Miles, Deaths Caused By Bedrails, JAGS, vol. 45, No. 7 (Jul. 1997), pp. 797–801.

*Primary Examiner*—Michael F. Trettel
*Attorney, Agent, or Firm*—Renner, Kenner, Greive, Bobak, Taylor & Weber

[57] ABSTRACT

A pad for preventing patient entrapment between a mattress supported by a bed frame and a bed rail movable with respect to the bed frame. The pad includes an elongate rail side opposite an elongate mattress side, a frame bottom connecting bottom edges of the rail side and the mattress side, a corner connecting the mattress side to the frame bottom, and at least one pair of elastic straps extending from the corner. Each distal end of each elastic strap is detachably securable to the other distal end and the pair of elastic straps are securable around either the bed frame or the bed rail.

13 Claims, 2 Drawing Sheets

GAP-FILLING PAD DISPOSABLE BETWEEN A MATTRESS AND A BED RAIL

TECHNICAL FIELD

Generally, the present invention is directed toward bedding equipment for use in hospitals, nursing homes, and critical care facilities. More particularly, the present invention is related to a pad for preventing entrapment between a mattress and a bed rail. Specifically, the present invention is directed to a pad that fits between a mattress and a bed rail that is detachably secured to one or the other.

BACKGROUND ART

In hospital nursing homes, it is common to provide bed rails that extend above the mattress level to prevent patients from rolling out of the bed. Known bed rails may either pivot away or move slidably downward to allow a patient to get out of bed or for hospital staff to care for the patient.

Recently, concerns have been raised regarding the needs for bed rails in view of the possible safety hazards. It has been recorded that patients have become asphyxiated between the bed rail and the side of the mattress as shown in FIG. 1 or in the triangular space created by the right angle of the bed rail and headboard when the mattress corner curves. This gap allows patients to bury their face against the mattress as their body slips downward. Trapped persons in this position do not have anything to grab to pull themselves upward, and one arm is usually pinned under their body. This is especially problematic for bed-ridden patients who are too weak to pull themselves from the gap.

It has also been reported that patients may slide either on their abdomen or on their back through the slot between head and foot rails. This results in the patient becoming lodged between the space between the rails and the bedframes. As a result, their body is trapped in an inverted position with their head and neck jammed into a hyperflexed or hyper-extended position by the floor.

One sure way to prevent the aforementioned problems is to develop standards for beds, rails, and mattresses as an integrated and total system for hospital care. Studies have revealed that the key dimensions of beds, rails, and mattresses vary greatly. This results in spacing between the head and foot rails of between 15–33 centimeters. Studies have shown that gaps of 6 centimeters maximum are needed to prevent death or severe injury from the examples noted above. It will also be appreciated that mattress thicknesses vary by as much as 5 centimeters and that mattresses become softer with age and shrink during refurbishing. Moreover, one-quarter of mattresses are replaced each year, whereas a bed lasts for 20 years. Accordingly, mattresses are often purchased from companies other than the bed manufacturer. Since there are more than 100 manufacturers of beds and side rails in the United States market, this problem is quite prominent. The non-specific relationship of mattresses, rails, and bedframes and variations in sizes of these items, allows the lateral distance from the mattress to the rails and headboard and the vertical distance from the mattresses to the top of the rails to vary widely.

Some other attempts at preventing entrapment include bolsters or long pillows that sit up on the mattress adjacent the bed rail. Unfortunately, this does not prevent the patient from becoming lodged between the bolster and the mattress. It also common for these pillows or bolsters to be placed on the floor during care of the patient and thus, the mattress becomes contaminated and must be cleaned.

DISCLOSURE OF INVENTION

Based upon the foregoing, it will be appreciated that there is a need in the art to provide a pad between a bed rail and associated mattress.

Another aspect of the present invention is to provide an elongate rectangular pad that is positionable between the bed rail and the mattress.

Still a further aspect of the present invention, as above, is to provide a pad with about the same height as the mattress and which fills the gap between the mattress and the bed rail with a minimal gap therebetween.

Still a further aspect of the present invention, as above, is to provide a pad which is attachable to the mattress, frame and/or rail with elastic straps.

Yet a further aspect of the present invention, as above, is to provide a plurality of straps extending from a corner of the pad, wherein the ends have fastening devices such that as the bed rail is removed from proximity of the mattress, the pad falls away but does not touch the floor.

An additional aspect of the present invention, as above, is to provide connection straps at the end of the pads so that the pads may extend the entire length of the mattress.

The foregoing and other aspects of the present invention, which shall become apparent as the detailed description proceeds, are achieved by a pad for filling in a gap between a frame-supported mattress and a bed rail, comprising a rail side, a mattress side opposite the rail side, the mattress side having a mattress frame corner, and a frame attachment device extending from the mattress frame corner to detachably secure the pad to the frame and allow positioning of the pad between the bed rail and the mattress.

The present invention also provides a pad for preventing patient entrapment between a mattress supported by a bed frame and a bed rail movable with respect to the bed frame, the pad comprising an elongate rail side opposite an elongate mattress side, a frame bottom connecting bottom edges of the rail side and the mattress side, a corner connecting the mattress side to the frame bottom, and at least one pair of elastic straps extending from the corner, each distal end of each elastic strap detachably securable to the other distal end, the pair of elastic straps securable around either the bed frame, the bed rail, or the mattress.

BRIEF DESCRIPTION OF THE DRAWINGS

For a complete understanding of the objects, techniques and structures of the invention, reference should be made to the following detailed description and accompanying drawings, wherein.

BEST MODE FOR CARRYING OUT THE INVENTION

Figure 2:
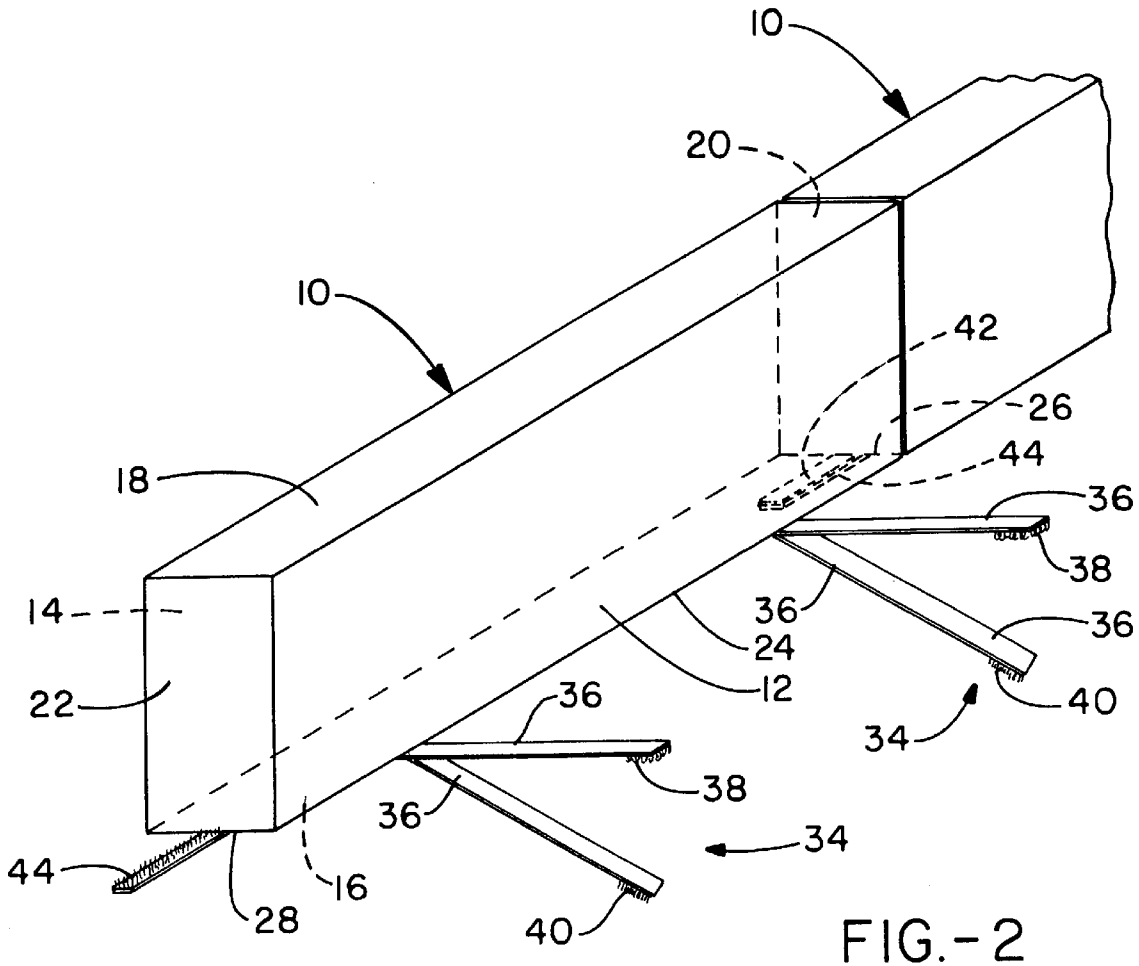
FIG. 2 is a perspective drawing of a pad according to the present invention.
Figure 1:
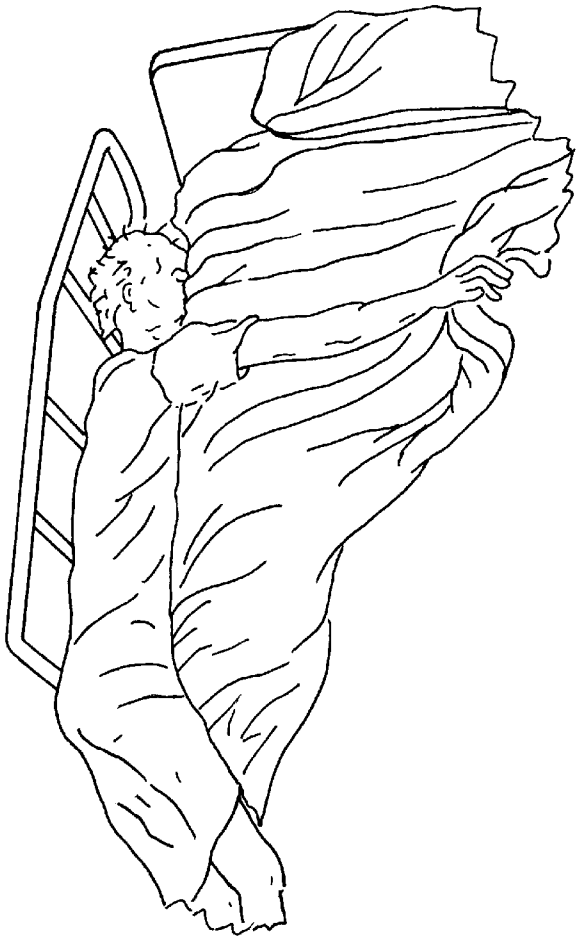
FIG. 1 is a schematic representation of a patient trapped between a bed rail and a mattress.
Figure 3:
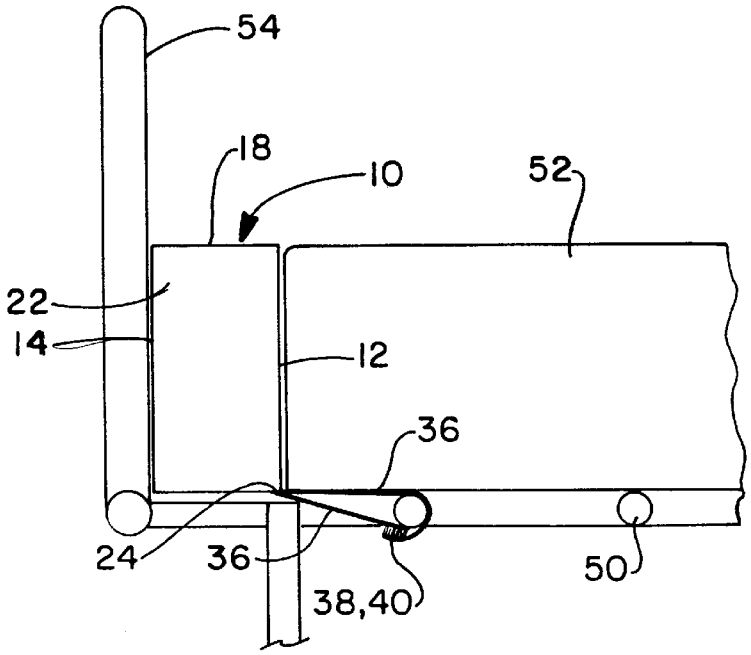
FIG. 3 is an end view of the pad disposed between a mattress and a bed rail in its normal position.

Referring now to the drawings and in particular, to FIGS. 2–3, it can be seen that a mattress-bed rail pad according to the present invention is designated generally by the numeral 10. Generally, the pad 10 is elongate and rectangular in shape and is constructed of a foam material enclosed in a fabric such as Staff-check™. This material is used to allow for repeated cleaning with disinfectants.

The pad 10 includes a mattress side 12 opposite a rail side 14. A frame bottom l6 connects the bottom edges of the mattress side 12 and the rail side 14 to one another. Opposite the frame bottom 16 is a mattress-level surface 18 which connects the opposite ends of the mattress side 12 and the rail side 14 to one another. An end panel 20 connects the sides 12 and 14 and the frame bottom 16 and mattress-level surface 18 to one another. Opposite the end panel 20 and connecting the remaining surfaces in a like manner, is an attaching panel 22.

A mattress-frame corner 24 is defined by the intersection of the mattress side 12 with the frame bottom 16. An end-panel/frame bottom corner 26 is defined by the interconnection of the end panel 20 and the frame bottom 16. In a similar manner, an attaching panel/frame bottom corner 28 is defined by the attaching panel 22 and the frame bottom 16.

At least one frame attachment device 34 extends from the mattress-frame corner 24 as best seen in FIG. 2. Although two devices 34 are shown, it will be appreciated that any number of devices may be employed. The frame attachment devices 34 include a pair of straps 36, preferably made of an elastic material. The straps 36 provide a first attaching material 38 with a hook-type fastener at one end while the second strap provides a loop-type fastening material 38 at its end removed from the corner 24. Those skilled in the art will appreciate that other types of fastening devices may be used at the end of the straps 36, such as snaps, buttons, ties, or the like.

A pad connection strap 42 extends along the length of the frame bottom 16 and is medially positioned between the mattress side 12 and the rail side 14. A pad attachment strap 44 extends away from the attachment/frame bottom corner 28 in about the same medial position as the strap 42. Accordingly, if the pads 10 are to be connected end-to-end, the strap 42 is connected to the strap 44. In the preferred embodiment, the strap 44 is constructed of a hook-type fastener while the strap 44 is constructed of a loop-type fastener. Of course, other devices for fastening the two pads end-to-end may be employed such as snaps, buttons, strings, and the like.

Figure 4:
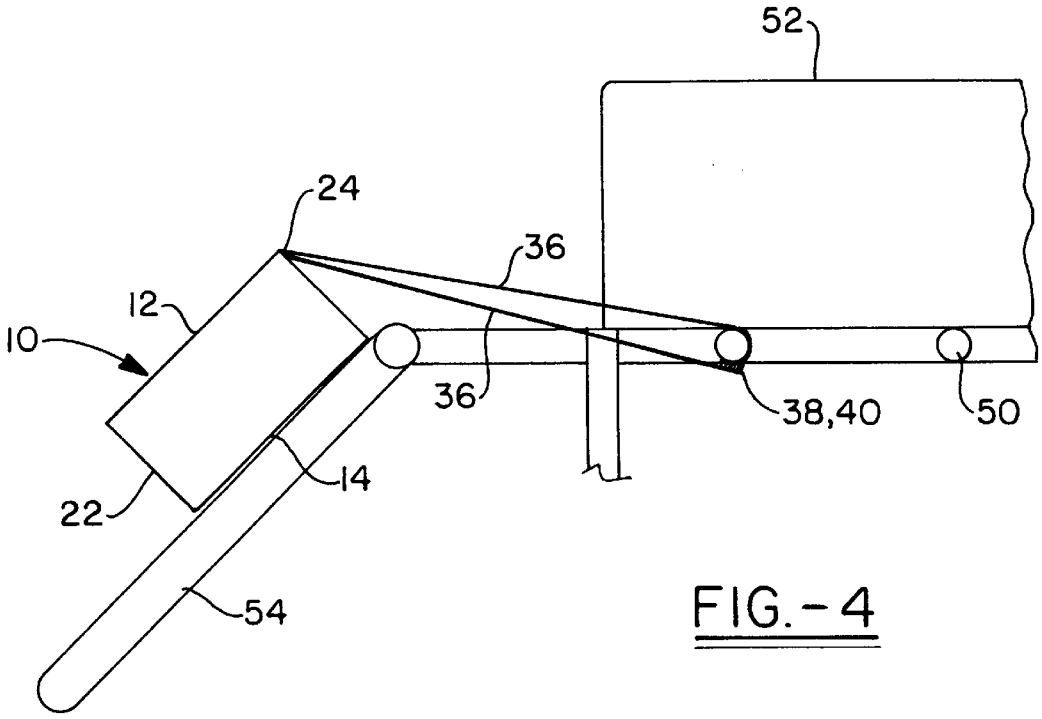
FIG. 4 is an end view of the pad with the bed rail in a distended position.

In use, as seen in FIGS. 3 and 4, a bed frame 50 supports a mattress 52. Extending from a side of the bed frame 50 is a bed rail 54 that is either pivotable away from the bed frame 50 as shown, or the rail may slide downwardly away from the top surface of the mattress 52. The pad 10 is installed lengthwise along the edge of the mattress 52 with the mattress frame corner 24 adjacent the mattress 52 and the supporting structure of the bed frame 50. The care provider will lift the mattress 52 and secure the attachment devices 34 about the bed frame 50, the mattress 52, or other available structure. The length of these straps 36 may be adjusted so that the bed 10 is adjacent the mattress 52, as best seen in FIG. 3.

At this time, the patient is placed on the mattress 52 and the bed rail is placed in its retention position such that the gap between the mattress 52 and the bed rail 54 is removed. Those skilled in the art will appreciate that the pads 10 may be sized to accommodate varying levels of mattress thickness and to accommodate various widths between the mattress 52 and the bed rail 54.

At such time when the bed rail 54 is moved to its distended position, the pad 10 is allowed to drape downwardly over the bed rail or bed frame 50 without touching the supporting floor by virtue of the elastic straps 36. This eliminates the need to continually disinfect the pad for contacting the floor.

Based upon the foregoing, it is apparent that several advantages may be realized by using the pad 10. The pad 10 allows for filling gaps between a bed rail and mattress so as to prevent entrapment or elopement of a patient between the mattress and the bed rail. Accordingly, this prevents the patient from becoming injured or asphyxiated. Still yet another advantage of the present invention is that it may be connected end-to-end to allow for filling a gap along the entire length of the mattress and bed rail. Still yet another advantage of the present invention is that it employs an attachment device which allows it to fall away from the bed when needed without touching the floor and becoming dirty.

Thus, it can be seen that the objects of the invention have been obtained by the structure presented above. While in accordance with the patent statutes, only the best mode and preferred embodiment of the invention has been presented and described in detail, it is to be understood that the invention is not limited thereto or thereby. Accordingly, for an appreciation of true scope and breadth of the invention, reference should be made to the following claims.

What is claimed is:

1. A pad for filling in a gap between a frame-supported mattress and a bed rail, comprising:

a rail side;

a mattress side opposite said rail side, said mattress side having a mattress frame corner; and a frame attachment device extending from said mattress frame corner to detachably secure the pad to the frame and allow positioning of the pad between the bed rail and the mattress, wherein said frame attachment device comprises at least one pair of elastic straps, each said elastic strap having a fastening device at an end opposite said mattress-frame corner, said fastening devices mateable with one another, said elastic straps allowing the pad to fall away from the mattress when the bed rail moves away form the mattress, the pad remaining detachably secured to the frame.

2. The pad according to claim 1, wherein said mattress side has a thickness substantially equal to the thickness of the mattress.

3. The pad according to claim 1, wherein said elastic straps are sized to prevent the pad from touching a floor supporting the frame when the bed rail moves away from the mattress.

4. The pad according to claim 1, further comprising:

an end panel connecting one edge of said rail side to a corresponding edge of said mattress side, said end panel having an end panel corner;

an attaching panel connecting another edge of said rail side to another corresponding edge of said mattress side, said attaching panel having an attaching panel corner;

a frame bottom surface extending between said end panel corner to said attaching panel corner;

a pad connection strap extending along at least a portion of said frame bottom surface; and a pad attachment strap extending from said end panel corner detachably securable to said pad connection strap of an adjacent pad.

5. A pad for preventing patient entrapment between a mattress supported by a bed frame and a bed rail movable with respect to the bed frame, the pad comprising:

an elongate rail side opposite an elongate mattress side;

a frame bottom connecting bottom edges of said rail side and said mattress side;

a corner connecting said mattress side to said frame bottom; and at least one pair of elastic straps extending from said corner, each distal end of each said elastic strap detachably securable to the other distal end, said pair of elastic straps securable around either the bed frame, the bed rail, or the mattress.

6. The pad according to claim 5, further comprising:

an end panel connecting said rail side to said mattress side and said frame bottom;

an attaching panel opposite said end panel connecting said rail side to said mattress side and said frame bottom; and means for connecting the pad to an adjacent pad so that said end panel is proximally positioned near an attaching panel of the adjacent pad.

7. The pad according to claim 6, wherein said connecting means comprises:

a pad connection strap extending along the length of said frame bottom; and a pad attachment strap extending from said attaching panel, wherein said pad attachment strap is detachably securable to said pad connection strap of the adjacent pad.

8. The pad according to claim 5, wherein said pad moves away from a position adjacent the mattress, yet remains secured to either the bed frame or the bed rail when the bed rail is moved away form the bed frame.

9. The pad according to claim 5, wherein said mattress side and said rail side are sized substantially the same width as the adjacent mattress.

10. The pad according to claim 5, wherein said frame bottom is sized substantially the same width as any gap between the mattress and the bed rail in an upright position.

11. A pad for filling in a gap between a frame-supported mattress and a bed rail, comprising:

a rail side;

a mattress side opposite said rail side, said mattress having a mattress frame corner;

a frame attachment device extending from said mattress frame corner to detachably secure the pad to the frame and allow positioning of the pad between the bed rail and the mattress;

an end panel connecting one edge of said rail side to a corresponding edge of said mattress side, said end panel having an end panel corner;

an attaching panel connecting another edge of said rail side to another corresponding edge of said mattress side, said attaching panel having an attaching panel corner;

a frame bottom surface extending between said end panel corner to said attaching panel corner;

a pad connection strap extending along at least a portion of said frame bottom surface; and a pad attachment strap extending from said end panel corner detachably securable to said pad connection strap of an adjacent pad.

12. A pad for filling in a gap between a frame-supported mattress and a bed rail, comprising:

a rail side;

a mattress side opposite said rail side;

a frame bottom connecting bottom edges of said rail side to said mattress side;

a mattress-level surface connecting top edges of said rail side to said mattress side, wherein said fame bottom is positionable upon the frame and wherein said mattress side has a thickness substantially equal to the thickness of the mattress such that said mattress level surface is substantially level with the mattress; and a frame attachment device extending from either said mattress side or said frame bottom to detachably secure the pad to either the frame or the mattress and allow positioning of the pad between the bed rail and the mattress.

13. The pad according to claim 12, wherein said frame attachment device comprises at least one strap having a fastening device at a distal end detachably securable to the frame or the mattress, said strap allowing the pad to fall away from the mattress when the bed rail moves away from the mattress, the pad remaining detachably secured to either the frame or the mattress.

* * * * *